US005192655A

United States Patent [19]

Chan et al.

[11] Patent Number: 5,192,655

[45] Date of Patent: Mar. 9, 1993

[54] SILVER HALIDE ELEMENTS WITH IMPROVED SPEED AND LOW FOG

[75] Inventors: Dominic M. Chan, Wilmington, Del.; Raymond J. LeStrange, Hendersonville, N.C.

[73] Assignee: E. I. du Pont de Nemours and Company, Wilmington, Del.

[21] Appl. No.: 726,331

[22] Filed: Jul. 5, 1991

[51] Int. Cl.[5] ..... G03C 1/09

[52] U.S. Cl. ..... 430/600; 430/603

[58] Field of Search ..... 430/600, 603

[56] References Cited

U.S. PATENT DOCUMENTS

| | | | |
|---|---|---|---|
| 3,565,625 | 2/1971 | Bloom et al. | 430/603 |
| 4,251,617 | 2/1981 | Scavron | 430/600 |
| 4,481,359 | 11/1984 | Beutel et al. | 430/600 |
| 4,514,492 | 4/1985 | LeStrange et al. | 430/600 |

*Primary Examiner*—Charles L. Bowers, Jr.
*Assistant Examiner*—Janet C. Baxter

[57] ABSTRACT

Substituted diaminedithio-containing compounds useful for improving the speed of a silver halide emulsion are described. These compounds can be added in small amounts to the emulsion preferably after the emulsion has been chemically sensitized and just prior to coating. Fog levels are not greatly affected which is surprising since conventional sensitizers generally do increase the fog level.

8 Claims, No Drawings

SILVER HALIDE ELEMENTS WITH IMPROVED SPEED AND LOW FOG

BACKGROUND OF THE INVENTION

1. Field of the Invention

This invention relates to the field of silver halide elements and more particularly to silver halide elements with improved speed and low fog. Still more particularly, this invention relates to a novel group of silver halide sensitizers useful in said elements.

2. Discussion of the Prior Art

Silver halide elements useful in recording photographic images are well-known in the prior art and this entire art field has been well-described. In an effort to increase the usefulness of these elements, there have been numerous attempts to increase the speed of the film elements made from these silver halide elements. Many of these attempts have been made by adding various adjuvants to the silver halide during the emulsion making step. These additives are usually sulfur compounds as it is well-known that the addition of compounds that contain labile sulfur will indeed act as a speed increasing adjuvant. However, most of these adjuvants also cause an undesirable increase in emulsion fog. So, the user must take care that not too much of the speed increasing compound is added.

Various cysteine compounds have been tried in silver halide emulsions to get the increased speed effect. Although some of these have been successful, fog is also a problem with these compounds.

SUMMARY OF THE INVENTION

It is an object of these invention to provide a novel composition for increasing speed within a gelatino, silver halide emulsion system without a subsequent, deleterious increase in fog. These and yet other objects can be achieved in a photosensitive element having at least one gelatino silver halide emulsion coated thereon wherein the improvement comprises said emulsion containing a sensitizing amount of a substituted diamine-dithio-containing compound of the formula selected from the group consisting of:

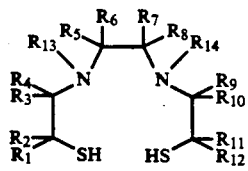

(a)

or a photographically suitable salt thereof wherein:

each of $R_1$-$R_{12}$ individually is selected from the group consisting of H, alkyl of 1-10 carbon atoms, —COOR and —A—COOR wherein A is a straight or branched chain alkylene of 1-5 carbon atoms, and R is (a) H, (b) alkyl of 1-10 carbon atoms, (c) phenyl or benzyl optionally substituted with up to 5 ring substituents each selected from alkyl of 1-4 carbon atoms; each of $R_{13}$ and $R_{14}$ individually is selected from the group consisting of H and alkyl of 1-10 carbon atoms containing zero or 1 heteroatoms selected from N, O or S and

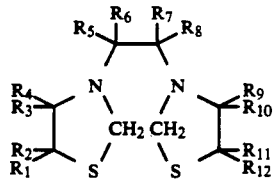

(b)

or a photographically suitable salt thereof wherein:

each of $R_1$-$R_{12}$ individually is selected from the group consisting of H, alkyl of 1-10 carbon atoms, —COOR and —A—COOR wherein A is a straight or branched chain alkylene of 1-5 carbon atoms, and R is (a) H, (b) alkyl of 1-10 carbon atoms, (c) phenyl or benzyl optionally substituted with up to 5 ring substituents each selected from alkyl of 1-4 carbon atoms.

DETAILS OF THE INVENTION

Typical substituted diaminodithio containing compounds suitable herein useful within the ambit of this invention include those described by Blondeau et al., Can. J. Chem., 45, 49 (1967). Also procedures disclosed by Burns et al. European Patent Application 163,119 and Kung European Patent Application 200,211 can be employed. Compounds especially useful include:

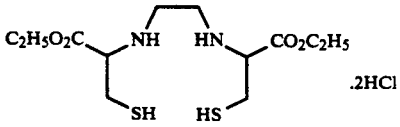

.2HCl (also referred to herein as Compound A)

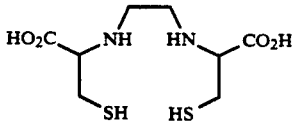

(also referred to herein as Compound B)

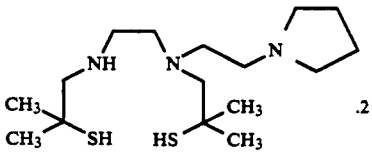

.2 Oxalic acid (also referred to herein as Compound C)

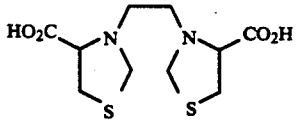

(also referred to herein as Compound D).

These sensitizers may be added to a gelatino, silver halide emulsion during the sensitization step or they may be added just prior to coating. They may be added in amounts easily determined by one of normal skill in the art. Preferably, they are added in amounts of 0.1 to 40 mg/1.5 mole of silver halide and most preferably in amounts of 1 to 10 mg/1.5 mole of silver halide. They may be added as a dilute solution made up in water, preferably made slightly acid, or other emulsion compatible solvents.

Gelatino, silver halide elements useful within the ambit of this invention are legion in number and include silver bromide, silver iodide, silver chloride or mixtures of two or more of these halides. These silver halides may be made by any of the conventional processes to yield any of the conventional crystal shapes such as cubic, rhombic, tabular, etc. These elements are useful as negative or positive-working systems for the recording of images thereon. Particularly useful systems are those used to record medical X-ray information, for example.

These silver halide emulsions may contain other sensitizers including those described in this invention. These sensitizers include labile sulfur compounds such as sodium thiosulfate and thionex, for example, as well as metal salts such as gold thiocyanate. Other adjuvants such as antifoggants, stabilizers, dyes, wetting and coating agents, antistatic agents, hardeners, etc. may also be present within these systems.

The emulsions prepared according to the teachings of this invention may be coated by any of the standard, well-known coating procedures (e.g. skim, bar, slide, etc.) on any of the conventional supports (e.g. paper, films, etc.). Particularly preferred supports include dimensionally stable polyethylene terephthalate on which thin, substratums of resins and gel layers have been previously coated in order to enhance the coating of the aqueous emulsions. After the emulsion layer or layers have been applied, thin, hardened gelatin protective layers may be applied supra thereto.

A particularly preferred system would be a high speed, gelatino silver iodobromide system especially useful for recording medical X-ray images and double-side coated on a polyethylene terephthalate film support, said support containing sufficient dye to impart a blue color to the support, and having hardened, gelatin layers overcoated on the emulsion layer. The sensitizers of this invention are then added to the emulsion after said emulsion has been fully digested with gold and sulfur to achieve an optimum sensitivity.

This invention will now be illustrated by the following specific examples of which Example 2 is considered to be the best mode. All parts and percentages are by weight unless otherwise indicated.

Preparation of Compounds A, B, C and D

Compound A and B were prepared according to published procedures by Blondeau et al., Can. J. Chem., 15 45, 49 (1967).

Compound C was prepared by a procedure similar to the one that was disclosed by Burns et al. in European Patent Application 163,119 or Kung et al. in European Patent Application 200,211.

Compound D was prepared by the following procedure. To a suspension of 3.0 g of Compound B in 60 ml of water was added 2.5 ml of a 37% aqueous formaldehyde solution. After stirring for a total of 84 hr., the white solid was collected by filtration and washed with acetone and dried to 2.8 g of Compound D (m.p. 195–196 C.).

EXAMPLE 1

A standard, large grain, gelatino, silver halide emulsion containing ca. 98 mol percent bromide and ca. 2 mol percent iodide was prepared and sensitized fully with gold and sulfur as well-known to those skilled in the art. This emulsion was eminently suitable for the preparation of high speed medical X-ray films. The emulsion was then split into several portions and further sensitized with the compounds of this invention as shown. Each portion was further treated with conventional antifoggants, stabilizers, wetting and coating aids and coated on 7 mil blue tinted polyethylene terephthalate film base which had previously been coated with a resin sublayer followed by a thin gelatin layer. Samples from each coating were then exposed through a $\sqrt{2}$ wedge and developed, fixed, washed and dried as is well-known. Sensitometric results follow:

| Sample | Amount Added (mg/1.5 mol AgX) | Speed | Base + Fog |
|---|---|---|---|
| Control No Add'l. Sens | | | 0.17 |
| (avg. of 3) | | 247 | |
| Cysteine | 20 | 303 | 0.18 |
| Compound A | 20 | 292 | 0.18 |
| Compound B | 20 | 312 | 0.19 |
| Compound C | 20 | 296 | 0.18 |

This example shows that the addition of the diaminodithio-containing compounds of this invention will produce excellent speed over controls with no additional sensitizer and equivalent speeds to that of cysteine alone. Little or no increase in fog was noted over the control.

EXAMPLE 2

An emulsion similar to that described in Example 1 was prepared and split into four (4) portions. One (1) sample was kept as a Control. To the other three (3) portions sensitizing compounds representing this invention were added at 5 mg/1.5 moles of silver halide just prior to coating. Each portion was coated, overcoated and dried and samples exposed, developed, fixed, washed and dried as described in Example 1. The following results were obtained:

| Sample | Speed | Base + Fog |
|---|---|---|
| Control | 242 | 0.17 |
| Compound A | 261 | 0.15 |
| Compound B | 355 | 0.18 |
| Compound C | 263 | 0.16 |

EXAMPLE 3

An emulsion similar to that described in Example 1 was prepared. This emulsion was split into eight (8) portions. One (1) portion was kept as a Control (no further additions). To the remainder, cysteine or N,N'-dicysteinyl ethane (Compound B) or combinations of these two compounds were added as shown below. Each portion was then coated, overcoated, dried, sampled, exposed, developed, fixed, washed and dried as detailed in Example 1 with the following sensitometric results:

| Cysteine (mg/1.5 moles of AgX) | Compound B (mg/1.5 moles of AgX) | Speed | Base + Fog |
|---|---|---|---|
| None | None | 245 | 0.16 |
| None | 10 | 332 | 0.22 |
| 10 | None | 284 | 0.16 |
| 10 | 10 | 343 | 0.18 |
| 20 | None | 319 | 0.17 |
| 20 | 10 | 362 | 0.21 |
| 40 | None | 301 | 0.20 |
| 40 | 10 | 347 | 0.24 |

This table shows that the speed effect of Compound B is additive to cysteine and combinations of the two may be used for optimum speed.

EXAMPLE 4

In this example, a silver halide emulsion similar to that described in Example 1 was prepared and split into five (5) portions. One (1) portion was kept as control. In the remaining four (4) portions, 10 mg/1.5 moles of silver halide of the sensitizers described below were added to each sample prior to coating. The overcoat, drying, exposing, fixing, washing and drying steps were the same as described in Example 1 with the following results:

| Compound Added | Speed | Base + Fog |
|---|---|---|
| None - Control | 184 | 0.17 |
| Compound B | 273 | 0.22 |
| Thiazolidine Carboxylic Acid | 232 | 0.19 |
| Compound D | 280 | 0.23 |
| Cysteine | 196 | 0.20 |

From this example, it can be seen that only the diaminodithiol-containing compounds of this invention serve to increase the speed over the control and even over prior art sensitizing compounds.

What is claimed is:

1. In a photosensitive element having at least one gelatino silver halide emulsion coated on a support wherein the improvement comprises said emulsion containing a sensitizing amount of a cysteine derivative selected from the group consisting of:

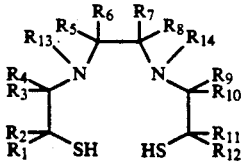

(a)

or the HCl or oxalic acid salt thereof wherein each of $R_1$–$R_{12}$ individually is selected from the group consisting of H, alkyl of 1–10 carbon atoms and —COOR;

R is H, alkyl of 1–10 carbon atoms, unsubstituted phenyl or phenyl substituted with up to 5 ring substituents each selected from alkyl of 1–4 carbon atoms;

each of $R_{13}$ and $R_{14}$ individually is selected from the group consisting of H and alkyl of 1–10 carbon atoms containing zero of 1 heteroatoms selected from N, O or S and

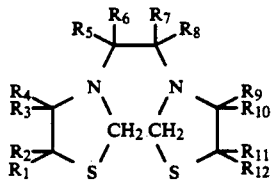

(b)

or the HCl or oxalic acid salt thereof wherein:

each of $R_1$–$R_{12}$ individually is selected from the group consisting of H, alkyl of 1–10 carbon atoms and —COOR;

R is H, alkyl of 1–10 carbon atoms, unsubstituted phenyl or phenyl substituted with up to 5 ring substituents each selected from alkyl of 1–4 carbon atoms.

2. The photosensitive element of claim 1 wherein said cysteine derivative is present in said emulsion in the range of 0.1 to 40 mg/1.5 moles of silver halide present.

3. The photosensitive element of claim 1 wherein said derivative is

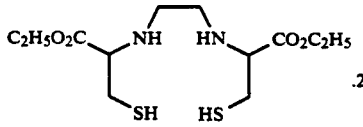

.2HCl.

4. The photosensitive element of claim 1 wherein said derivative is

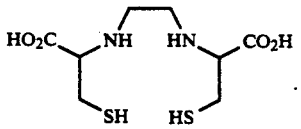

5. The photosensitive element of claim 1 wherein said derivative is

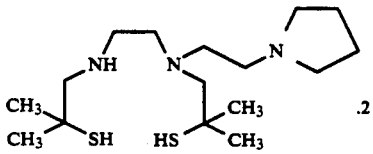

.2 Oxalic acid.

6. The photosensitive element of claim 1 wherein said derivative is

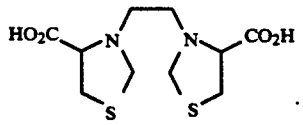

7. The photosensitive element of claim 1 wherein said $R_1$–$R_{12}$ independently represents —A—COOR wherein A is a straight or branched chain alkylene of 1–5 carbons and R is hydrogen, alkyl of 1–10 carbon atoms, unsubstituted phenyl or phenyl with up to 5 ring substituents each independently selected from alkyl of 1–4 carbon atom.

8. The photosensitive element of claim 7 wherein said R is unsubstituted benzyl or benzyl with up to 5 ring substituents each selected from alkyl of 1–4 carbon atoms.

* * * * *